US006326071B1

(12) United States Patent
Francoeur

(10) Patent No.: US 6,326,071 B1
(45) Date of Patent: Dec. 4, 2001

(54) REVERSE THERMAL LABEL

(75) Inventor: Roger L. Francoeur, Omaha, NE (US)

(73) Assignee: Nashua Corporation, Nahsua, NH (US)

( * ) Notice: Subject to any disclaimer, the term of this patent is extended or adjusted under 35 U.S.C. 154(b) by 0 days.

(21) Appl. No.: 08/796,860

(22) Filed: Feb. 6, 1997

(51) Int. Cl.[7] ..... B41M 5/40

(52) U.S. Cl. ..... 428/40.1; 283/81; 428/41.6; 428/41.7; 428/41.8; 428/42.1; 428/913; 503/200; 503/226

(58) Field of Search ..... 428/40.1, 41.6, 428/41.7, 41.8, 42.1, 913; 503/200, 226; 283/81

(56) References Cited

U.S. PATENT DOCUMENTS

| | | | | |
|---|---|---|---|---|
| 4,591,887 | * | 5/1986 | Arbree | 428/138 |
| 4,738,472 | * | 4/1988 | Shibata | 428/41.6 |
| 5,043,314 | * | 8/1991 | Suzuki | 503/226 |
| 5,294,470 | * | 3/1994 | Ewan | 428/41.6 |
| 5,773,386 | | 6/1998 | Langan | 503/226 |

* cited by examiner

*Primary Examiner*—Nasser Ahmad
(74) *Attorney, Agent, or Firm*—Testa, Hurwitz & Thibeault, LLP

(57) ABSTRACT

An adhesive-backed label useful for security applications. The label comprises a substrate onto which has been coated, in order, at least a thermally-imprintable color producing layer, and an adhesive layer, preferably a pressure-sensitive adhesive.

12 Claims, 4 Drawing Sheets

REVERSE THERMAL LABEL

CROSS REFERENCE TO RELATED APPLICATIONS

None

STATEMENT REGARDING FEDERALLY SPONSORED RESEARCH OR DEVELOPMENT

None

FIELD OF THE INVENTION

This invention relates to adhesive labels. In particular, it relates to adhesive labels which may be used in security applications, e.g., where it is desired to hide or cover surface indicia or provide a means of indicating label tampering.

BACKGROUND OF THE INVENTION

It is common practice in industry to use adhesive-backed labels bearing indicia such as price, description, or SKU (stock kind unit) number to identify a particular item. As the information printed on the label becomes outdated, the old label must either be removed from the product, or covered over with a label bearing the new information. To ensure that individuals have not tampered with the label, it is desirable that adhesive labels have a security feature that provides visual indication when the label has been tampered with.

The advent and widespread acceptance of universal product code (UPC) scanning technology has placed additional demands on the quality of the labels bearing barcodes. The relative opacity of the label material is an important factor in the scanning quality of the label surface.

For "cover-up" applications, the label opacity is critical. For example, when an old price label is being covered up with a new label, it is important that the old information not be seen through the new label, for customer relation purposes. In industries such as automotive parts and apparel, where inventory is bought and sold repeatedly, it is important that the original or previous label containing old price and/or the previous vendor's name not be visible. In another case, outdated printed indicia on the surface of a packing carton itself may need to be covered up or changed; for example, if boxes for containing a product such as a toy have been prepared and the box artwork must be changed to something more appealing, a cover-up label with the new artwork could simply be affixed over the old, thus eliminating wasteful scrapping of the old cartons.

SUMMARY OF THE INVENTION

The invention features an adhesive label comprising a substrate onto which has been coated at least, in order, a thermally-imprintable color producing layer, and an adhesive layer, preferably a pressure-sensitive adhesive. Such reverse thermal labels desirably include a release sheet to protect the adhesive before it is used.

The thermally-imprintable color producing layer may be such as described in, e.g., Arbree et al. U.S. Pat. No. 4,591,887 at column 4, lines 16–60. Such a layer typically comprises a colorless or pale colored leuco dye, preferably in particulate form; an acidic developer substance to cause the dye to undergo color transformation upon imagewise application of heat to the thermally-imprintable color producing layer; a polymeric binding material; and an acid neutralizing (basic), preferably particulate, material for reducing background discoloration.

In one embodiment of the invention the thermally-imprintable color producing layer is uniformly heated to react the leuco dye and developer and thus render the label opaque. In another embodiment, certain indicia may be imprinted in the color producing layer upon imagewise application of heat to form a sort of watermark to enable identification of an item to which the label is affixed.

In another embodiment of the invention, a method of protecting against enclosure tampering involves affixing an activated label as disclosed herein to an enclosure to be protected. Peeling off the label to reveal the colored thermal layer provides visible indication, e.g., a company logo or security pattern, that the container has been opened.

In yet another embodiment of the invention, an adhesive label substantially as described herein can further be coated with a second thermal coating on a second surface (i.e., the uncoated side of the label) to allow printing of indicia thereupon, such as price information, barcodes, SKU numbers, or descriptive information.

A further embodiment of the invention, described herein, is a couponing method that uses reverse thermal labels of the invention which function as coupons or gaming tickets.

BRIEF DESCRIPTION OF THE DRAWINGS

The invention will be more fully understood by reference to the following Detailed Description Of The Invention in conjunction with the following Drawings, of which.

DETAILED DESCRIPTION OF THE INVENTION

Labels in accordance with this disclosure may be made by coating a thermally-imprintable color producing layer onto a substrate, followed by coating an adhesive on the color producing layer. Coating techniques well-known in the art may be used for applying the thermal and adhesive coatings.

Figure 1:
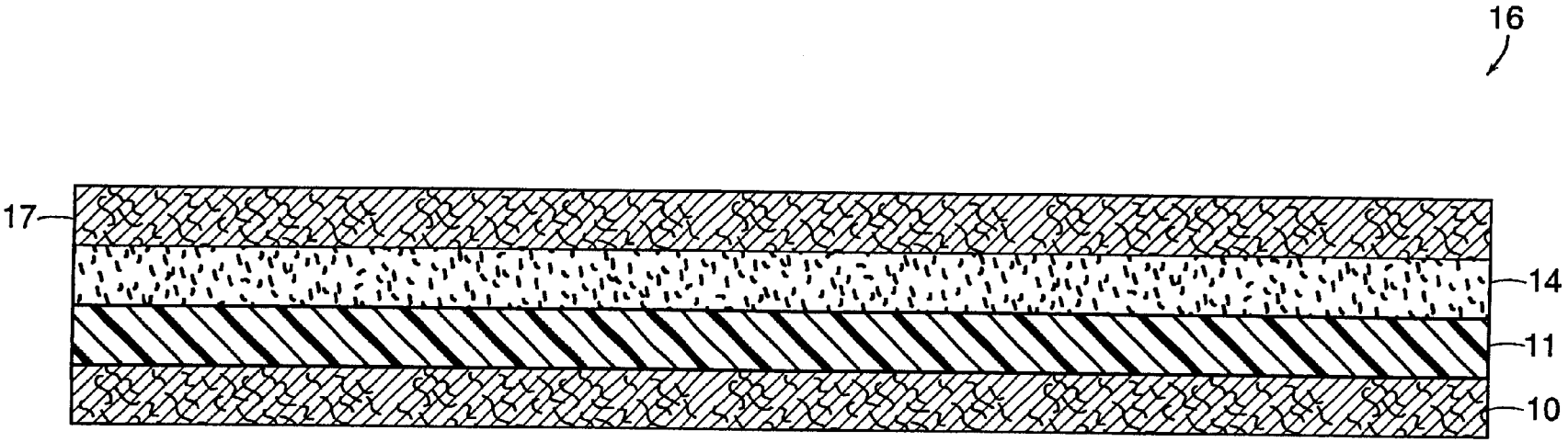
FIG. 1 is a schematic cross-sectional view of a label in accordance with the present invention.

Referring to the drawings, FIG. 1 schematically illustrates in cross-section a label 16 in accordance with the invention. It comprises a typically medium weight cellulosic substrate 10. Other substrates may be used, such as biaxially-oriented films or non-woven materials, e.g., MYLAR or TYVEK-type materials or any other suitable substrate. Adhered to the top side of the substrate is a thermally-imprintable color producing layer 11 that desirably has a coating weight of approximately 3 to 8 grams solids per square meter. Color producing layer 11 is covered by an adhesive layer 14 which in turn is protected until use by release sheet 17.

Color producing layer 11 is a thermally sensitive, imagewise exposable layer which can vary widely in composition. It may comprise a composition known in the art. It generally comprises an intimate mixture of pale colored or colorless leuco dye, an acidic substance which functions to develop the dye, a polymeric binder material, and a particulate neutralizing agent.

The dye of layer 11 may be of the type generally known in the art which is activated by contact with a proton donating (acidic) substance such as a metallized, e.g., zincated, organic acidic material. Exemplary dyes are fluoran, lactone, phthalide, or triaryl methane dyes such as crystal violet lactone, 3-N-cyclohexyl, N-methyl-amino 6-methyl-7-anilino fluoran, or 3-pyrrolidino-6-methyl-7-anilinofluoran. Other leuco dyes or the like known to those skilled in the art may be used. The dye is typically present in particulate form, preferably as particles in the micron size range for adequate resolution.

The acidic developer substance comprises an organic acidic material, optionally treated with a metal such as zinc. Examples of materials which may be used include bisphenol A, phenolic condensation products, and various low melting point organic acids or their esters. An exemplary developer is para-benzyl hydroxybenzoate.

The polymeric binder of layer 11, for processing purposes, is preferably at least partially water soluble. It comprises one or a mixture of resinous materials which act to hold the other constituents of layer 11 together. An exemplary binder material is polyvinyl alcohol. Other known binders which may be used include polyvinyl pyrrolidone, polyacrylamide, or modified celluloses.

The neutralizing agent contained in layer 11 may comprise a neutral colored, water-insoluble particulate material. In addition to the foregoing, layer 11 may also include inert fillers, lubricants, dispersants, and defoaming agents present in minor amounts as processing aids.

The thermally-imprintable layer may also include a barrier coat to ensure that the color is not developed prematurely, due to, e.g., moisture or plasticizer leaching out of the adhesive layer. For some thermal coatings which have inherent resistance to premature development, such coatings are probably not necessary. Thermally-imprintable coatings which are suitable for use in the invention include, for example, those disclosed in U.S. Pat. No. 4,591,887, the disclosure of which is incorporated herein by reference.

A pressure-sensitive or other type of adhesive layer 14 is deposited on color forming layer 11. Conventional label-type adhesives may be used, such as water-based acrylic adhesive coatings. So-called "aggressive" adhesives, which include some of the water-based acrylic adhesive coatings mentioned above, will work also. Adhesive layer 14 is deposited in a conventional manner, and desirably backed by a release sheet 17. Release sheet 17 may comprise paper coated with silicone or other suitable adhesive material.

In a preferred embodiment of the invention, when the adhesive label is used for tamper proof or security purposes, the thermally-imprintable layer and the adhesive layer adhere strongly together so that if one attempts to remove the label from the surface it is affixed to, the label tears and separates from the substrate such that the colored, thermally-imprintable layer substantially remains on the surface as evidence of attempted tampering. This advantage distinguishes these labels from other security-type labels in which the adhesive either releases completely from the substrate, or remains selectively thereupon. These reverse thermal labels are therefore enabled for use in a number of useful applications. For example, gaming tickets bearing a plurality of indicia comprising the game could be prepared by placing small reverse thermal labels of the disclosure onto a game card. The label stock would be an opaque substrate onto which a thermal coating in accordance with the disclosure is coated. Randomly generated indicia, e.g., numbers, could be printed in mirror image onto the thermally-imprintable layer of each label upon imagewise application of heat before affixation to the gaming card. When the game is played the label would be removed, revealing the thermal image remaining on the gaming card.

The reverse thermal labels also have application as coupon labels. Currently this is typically accomplished through the use of expensive double laminate material requiring two tier die cutting. An "activated" (i.e., the thermal layer has been heated to develop the color) reverse thermal label bearing coupon indicia on the non-coated side would be applied to a substrate, such as a flyer having advertising information about the product the coupon can be redeemed for. To use the system the customer would bring the flyer to a store, whereupon the store operator would peel the label off to redeem the coupon, and reveal the activated thermally-imprintable image, ensuring that the original coupon, and not a photocopy, was being redeemed. If such security or control of the coupon distribution is not necessary, the customer could peel the coupon off and redeem it. This latter method makes coupon shopping easier for customers, since this eliminates the bother of cutting or tearing coupons from a flyer.

This disclosure also contemplates the use of reverse thermal labels as high temperature warning labels or indicators on vessels or other equipment. For example, an unactivated reverse thermal label would be used to label laboratory glassware and would also desirably allow marking the outside surface to indicate the contents of the vessel. If the vessel contents are heat-sensitive, removing the label at the end of the experiment to reveal the thermal layer remaining on the surface, for example, would indicate if the vessel had been heated past a setpoint (which setpoint would of course correspond to the temperature at which the developing reaction occurs in the thermal coating.)

Another useful application of the disclosed labels is in protecting against container tampering, such as when dispensing pharmaceuticals. The pharmacist would place a reverse thermal label of the invention, perhaps bearing safety information about the prescription, over the cap on the prescription container so it adheres to the cap and the side walls, or, on a paper bag holding the prescription, the bag flap or folded-over portion of the bag, and the surface of the bag adjacent to the bag flap or the folded-over portion of the bag, so as to seal the bag. When the customer removes the label to enable opening the container, and also to reference the information printed on the label, the activated thermal coating remains on the surface as evidence that the label was affixed and that the package was opened.

Another use of the labels disclosed herein is in inventory control, where activated reverse thermal labels having different colored thermal layers keyed to the contents uniquely identify each package. The labels are affixed to a stock group and the thermal layer on the label shows a color which signifies some shared information about the contents, e.g., freshness date, etc.

Figure 2:
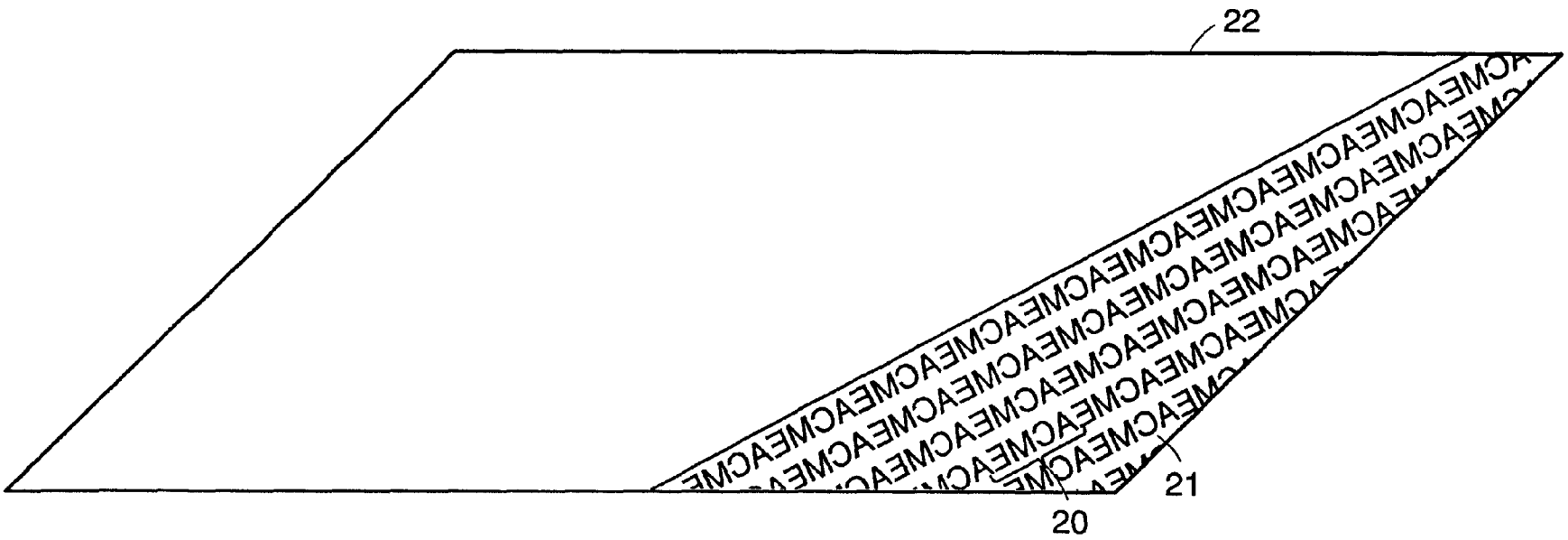
FIG. 2 illustrates an embodiment of the invention wherein a security pattern is formed on the thermally-imprintable color producing layer of the label.
Figure 3:
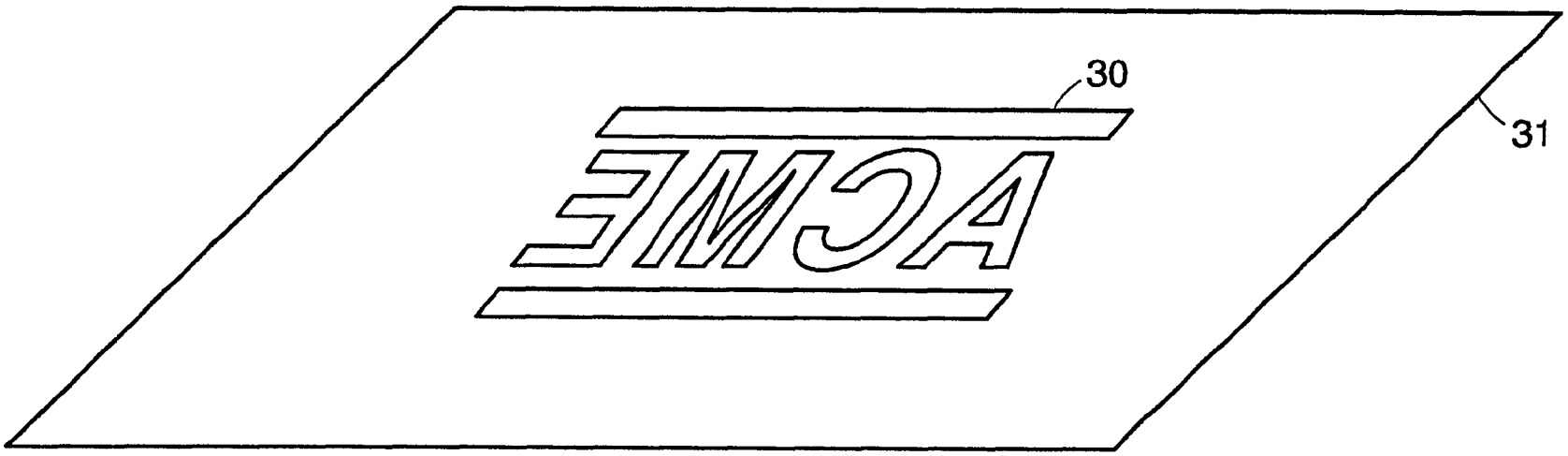
FIG. 3 illustrates an embodiment of the invention wherein a watermark is formed on the thermally-imprintable color producing layer of the label.
Figure 4:
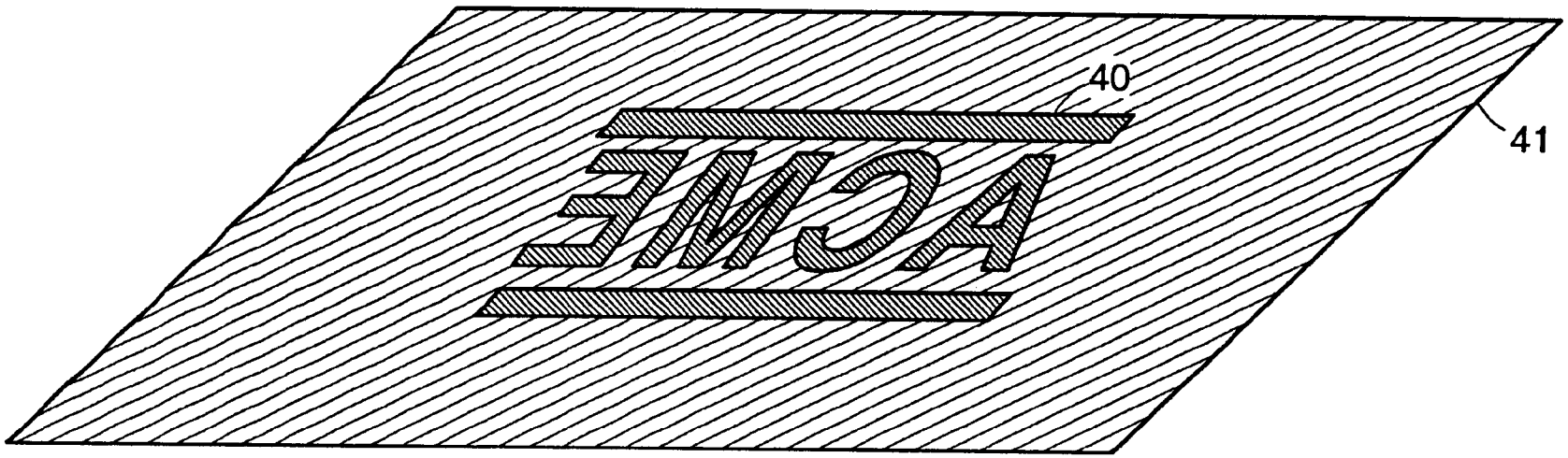
FIG. 4 illustrates an embodiment of the invention wherein a watermark is formed against a security pattern background on the thermally-imprintable color producing layer of the label.

To obtain the benefits of the invention, the thermally-imprintable layer should be activated (either before or after adhesive coating, or before or after label application), i.e., to react the leuco dye and developer and produce the desired pattern or color. To render the label opaque, the entire surface should be developed. The reaction need not proceed to completion, i.e., not all of the leuco dye in the coating need be developed. Furthermore, various security patterns may be printed on the thermal layer via imagewise application of heat, such as shown in FIG. 2, where a company name 20 is repetitively printed in pattern 21 (partially depicted) on the thermally-imprintable color producing layer of label 22. In another embodiment a watermark 30 could be printed onto the thermally-imprintable layer of label 31, such as shown in FIG. 3. When a translucent or even a transparent substrate is used for making the adhesive label, the watermark could be used as an authenticating device for consumers, and for manufacturers concerned about counterfeit goods. The watermark scheme could be used alone or in conjunction with a security background, such as in FIG. 4, showing watermark 40 and security pattern 41 printed onto the thermally-imprintable layer of label 42.

It is contemplated that the thermally-imprintable layer be developed before the adhesive and/or release sheet is applied. However, if an adhesive is used which would allow the thermally-imprintable layer to be developed after applying the adhesive, i.e., before or after the label is applied to a surface, this would give the end user the same printing options available to the label manufacturer, with the proper equipment.

It should be noted that other embodiments and variations of the invention will be apparent to those of ordinary skill in the art without departing from the inventive concepts contained herein. Accordingly, the invention should not be viewed as limited except as by the scope and spirit of the appended claims.

What is claimed is:

1. An adhesive label comprising:

an opaque substrate layer;

a thermally-imprintable color producing layer applied to a surface of said substrate layer; and an adhesive layer applied to said thermally-imprintable color producing layer.

2. The label of claim 1 further comprising a release sheet applied to said adhesive layer.

3. The label of claim 1 wherein said adhesive layer is a pressure-sensitive adhesive.

4. The label of claim 1, wherein said thermally-imprintable color producing layer comprises a leuco dye; an acidic developer substance; and a polymeric binding material.

5. The label of claim 4, wherein said thermally-imprintable color producing layer further comprises an acid neutralizing material for reducing background discoloration.

6. The label of claim 4, wherein said leuco dye is selected from the group consisting of fluoran, lactone, phthalide, or triaryl methane dyes.

7. The label of claim 4, wherein said acidic developer substance is selected from the group consisting of bisphenol A, phenolic condensation products, and para-benzyl hydroxybenzoate.

8. The label of claim 4, wherein said polymeric binding material is selected from the group consisting of polyvinyl alcohol, polyvinyl pyrrolidone, polyacrylamide, and modified celluloses.

9. The label of claim 1, wherein said substrate layer further comprises a second thermally-imprintable color producing layer applied to a second surface of said substrate layer.

10. The label of claim 1 further comprising a watermark imprinted in said thermally-imprintable color producing layer.

11. The label of claim 1 further comprising a security pattern imprinted in said thermally-imprintable color producing layer.

12. The label of claim 1 wherein said thermally-imprintable color producing layer further comprises a barrier coating thereupon.

* * * * *